US012345148B1

(12) United States Patent
Zeng et al.

(10) Patent No.: US 12,345,148 B1
(45) Date of Patent: Jul. 1, 2025

(54) SYSTEMS AND METHODS FOR CHARACTERIZING A SUBTERRANEAN FORMATION HAVING A FORMATION BOUNDARY SURFACE

(71) Applicant: Halliburton Energy Services, Inc., Houston, TX (US)

(72) Inventors: Tingting Zeng, Houston, TX (US); Robert P. Darbe, Tomball, TX (US); Eirik Hansen, Stavanger (NO); Siyang Song, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/402,175

(22) Filed: Jan. 2, 2024

(51) Int. Cl.
*E21B 7/04* (2006.01)
*E21B 44/00* (2006.01)

(52) U.S. Cl.
CPC ..... *E21B 44/00* (2013.01); *E21B 7/04* (2013.01)

(58) Field of Classification Search
CPC ..... E21B 7/04
See application file for complete search history.

(56) References Cited

U.S. PATENT DOCUMENTS

| | | | |
|---|---|---|---|
| 10,459,098 | B2 | 10/2019 | Grant et al. |
| 11,220,898 | B2 | 1/2022 | Pollack et al. |
| 11,307,321 | B2 | 4/2022 | Shen et al. |
| 11,409,016 | B2 | 8/2022 | Peng et al. |
| 11,480,045 | B2 | 10/2022 | Denisenko et al. |
| 11,613,930 | B2 | 3/2023 | Zhao et al. |
| 11,674,353 | B2 | 6/2023 | Zalluhoglu et al. |
| 2015/0134255 | A1 | 5/2015 | Zhang |
| 2015/0240616 | A1* | 8/2015 | Woodward ..... G05B 15/02 700/275 |
| 2019/0048702 | A1* | 2/2019 | Vorhoff ..... E21B 7/06 |
| 2019/0106974 | A1 | 4/2019 | Kuvaev et al. |
| 2019/0330968 | A1 | 10/2019 | Boone |
| 2020/0095860 | A1 | 3/2020 | Zalluhoglu et al. |

(Continued)

FOREIGN PATENT DOCUMENTS

WO 2021221697 A1 11/2021

OTHER PUBLICATIONS

International Search Report and Written Opinion dated Sep. 26, 2024 for related PCT Application No. PCT/ US2024/010050 filed Jan. 2, 2024.

*Primary Examiner* — Giovanna Wright
(74) *Attorney, Agent, or Firm* — K&L Gates LLP

(57) ABSTRACT

Systems and methods for characterizing a subterranean formation that include a drill bit for drilling a deviated wellbore through the formation and that repeatedly changes direction. Also included is a directional drilling system and measurement equipment to detect a property of the formation. A trajectory control system is operable to: receive a well log; determine a property of the wellbore; segment the well log based on the property; and correlate one of the segments with the well log previous to the segment to determine a matching score for the segment. If the matching score is equal to or greater than a minimum threshold, the segment was taken in the formation and at the same stratigraphical true vertical depth ("STVD"). If the matching score is less than the minimum threshold, the segment was not taken in the formation and not at the same STVD and the STVD is estimated.

18 Claims, 8 Drawing Sheets

(56) References Cited

U.S. PATENT DOCUMENTS

| | | | |
|---|---|---|---|
| 2021/0071477 | A1 | 3/2021 | Zhao et al. |
| 2021/0102457 | A1 | 4/2021 | Dupont et al. |
| 2021/0103843 | A1 | 4/2021 | Keller et al. |
| 2021/0181370 | A1 | 6/2021 | Zimmermann et al. |
| 2021/0222523 | A1 | 7/2021 | Sun |
| 2021/0340861 | A1 | 11/2021 | Al Ismail et al. |
| 2023/0038625 | A1 | 2/2023 | Wu et al. |

* cited by examiner

SYSTEMS AND METHODS FOR CHARACTERIZING A SUBTERRANEAN FORMATION HAVING A FORMATION BOUNDARY SURFACE

BACKGROUND

Oil and gas bearing rocks are often present in layered formations comprising strata. In the past, mostly vertical wells were drilled to produce hydrocarbons from these formations. However, the industry switched to deviated well drilling as wells that deviate from vertical and go along the productive formation can result in better production performance.

Geosteering is the act of adjusting the wellbore position (e.g., inclination and azimuth angles of drillbit) during the drilling process to reach one or more geological targets. Geosteering may also include controlling the position different portions of the wellbore, such as drilling through a particular formation. These changes may be based on geological information gathered before or while drilling. Geosteering may include the process of drilling a deviated well. Further, geological formations are not always horizontal, but can be angled relative to horizontal, have bends such as various formation dips, and can have faults (disruptions). The majority of the horizontal wells in the world are being geosteered to ensure maximum exposure to hydrocarbon containing rock and, consequently, better oil and gas extraction performance.

Geosteering may be conducted with the help of geosteering software configured to process collected data and assist the geologists in understanding the wellbore's position within the formation or oil/gas reservoir. The software may further be used for adjusting wellbore's position. To do so, the geosteering operation may include taking well log measurements along more than one wellbore. The well logs may then be correlated in a well-to-well correlation process, which involves comparing well log measurements from different wells to identify lithological boundaries of formations or oil/gas reservoirs. Although assisted with software, well log correlation is usually performed manually, which is a time-consuming process that requires expertise from a well log interpreter. Hence, well log correlation is often subjective and can be a bottleneck to characterizing downhole formations for planning wellbore trajectories.

Algorithmic approaches for well-to-well correlation such as dynamic time warping (DTW) are limited to utilization of correlation to offset wells. Therefore, these approaches suffer from the inherent heterogeneity of geophysical measurements from different wellbores, both from a geologic and data-quality perspective.

Therefore, there is a strong industry need for more efficient method and system for geosteering that is rigorous and repeatable and that would assist drilling rig operators and field service companies in generating an accurate geosteering guidance in a time efficient manner that overcomes the aforementioned limitations.

BRIEF DESCRIPTION OF THE DRAWINGS

Aspects of the disclosure are described with reference to the following figures, the features of which are not necessarily shown to scale. Some details of elements may not be shown or may be represented by conventional symbols in the interest of clarity and conciseness.

DETAILED DESCRIPTION

The present disclosure describes in improved trajectory control system usable for controlling a rotary steerable system during a wellbore drilling operation. For example, the trajectory control system can receive information from sensors capable of determining a position of the rotary steerable system within the wellbore. Based on the measured position, the trajectory control system can determine a wellbore trajectory error. That is, the trajectory control system can determine a difference between a planned trajectory of the wellbore and the actual trajectory of the wellbore. Using the wellbore trajectory error, the trajectory control system may perform a performance index algorithm to minimize further wellbore trajectory error based on trajectory changes of the rotary steerable system. A performance index of the performance index algorithm may be a function of the wellbore trajectory error in position and an error in attitude of the rotary steerable system, which may include an error in inclination of a drill bit controlled by the rotary steerable system, an error in an azimuth of the drill bit controlled by the rotary steerable system, or a combination thereof. A change to inclination and azimuth of the drill bit that produces the smallest performance index in the performance index algorithm may be provided from the trajectory control system to the rotary steerable system to adjust the trajectory of the drill bit.

These illustrative examples are given to introduce the reader to the general subject matter discussed in this disclosure and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
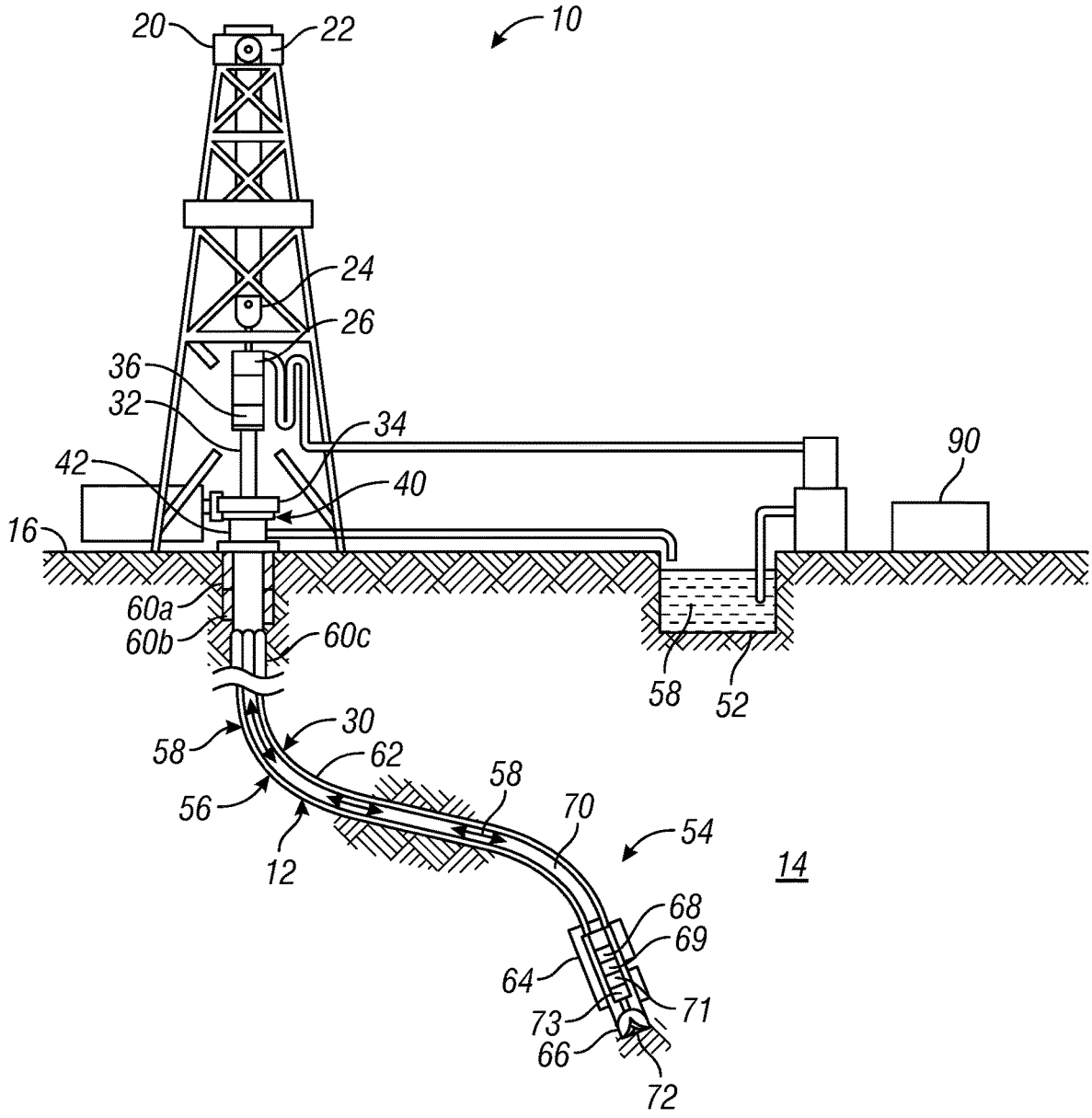
FIG. 1 illustrates a cross-sectional schematic view of an example of a well system incorporating a trajectory control system in accordance with one or more embodiments of the present disclosure.

Turning now the figures, FIG. 1 is a cross-sectional view of a well system 10 incorporating a trajectory control system 90 for drilling a wellbore 12 according to some examples of the present disclosure. The wellbore 12 extends through various earth strata in an oil and gas formation 14 (e.g., a subterranean formation) located below the well surface 16. The wellbore 12 may be formed of a single bore or multiple bores extending into the formation 14, and disposed in any orientation. At least some of the wellbore 12 is deviated, or "horizontal", and extends at least somewhat laterally relative to the surface. The well system 10 may include a derrick or drilling rig 20. The drilling rig 20 may include a hoisting apparatus 22, a travel block 24, and a swivel 26 for raising and lowering casing, drill pipe, coiled tubing, and other types of pipe or tubing strings or other types of conveyance vehicles, such as wireline, slickline, and the like. The wellbore 12 can include a drill string 30 that is a substantially tubular, axially-extending drill string formed of a drill pipe joints coupled together end-to-end.

The drilling rig 20 may include a kelly 32, a rotary table 34, and other equipment associated with rotation or translation of drill string 30 within the wellbore 12. For some applications, the drilling rig 20 may also include a top drive unit 36. The drilling rig 20 may be located proximate to a wellhead 40, as shown in FIG. 1, or spaced apart from the wellhead 40, such as in the case of an offshore arrangement with a subsea wellhead. One or more pressure control devices 42, such as blowout preventers (BOPS) and other well equipment, may also be provided at the wellhead 40 or elsewhere in the well system 10. Although the well system 10 of FIG. 1 is illustrated as being a land-based drilling system, the well system 10 may also be modified to be deployed offshore.

A drilling or service fluid source 52 may supply a drilling fluid 58 pumped to the upper end of the drill string 30 and flowed through the drill string 30. The fluid source 52 may supply any fluid utilized in wellbore operations, including drilling fluid, drill-in fluid, acidizing fluid, liquid water, steam, or some other type of fluid.

The well system 10 may have a pipe system 56. For purposes of this disclosure, the pipe system 56 may include casing, risers, tubing, drill strings, subs, heads or any other pipes, tubes or equipment that attaches to the foregoing, such as the drill string 30, as well as the wellbore and laterals in which the pipes, casing, and strings may be deployed. In this regard, the pipe system 56 may include one or more casing strings 60 cemented in the wellbore 12, such as the surface 60 *a*, intermediate 60 *b*, and other casing strings 60 *c* shown in FIG. 1. An annulus 62 is formed between the walls of sets of adjacent tubular components, such as concentric and non-concentric casing strings 60 or the exterior of drill string 30 and the inside wall of the wellbore 12 or the casing string 60*c*.

Where the subsurface equipment 54 is used for drilling and the conveyance vehicle is a drill string 30, the lower end of the drill string 30 may include a bottom hole assembly ("BHA") 64, which may carry at a distal end a drill bit 66. During drilling operations, a weight-on-bit is applied to the drill bit 66 as the drill bit 66 is rotated, thereby enabling the drill bit 66 to engage the formation 14 and drill the wellbore 12 along a predetermined path toward a target zone. In general, the drill bit 66 may be rotated with the drill string 30 from the drilling rig 20 with the top drive unit 36 or the rotary table 34, or with a downhole mud motor 68 within the BHA 64.

The BHA 64 or the drill string 30 may include various other tools, including a power source 69, a directional drilling system 71 (e.g., bent housing or rotary steerable system ("RSS")), and measurement equipment 73, such as measurement while drilling ("MWD") or logging while drilling ("LWD") instruments, sensors, circuits, or other equipment to provide information about the wellbore 12 or the formation 14, such as positioning, logging, or measurement data from the wellbore 12.

Measurement data and other information from the tools may be communicated using electrical signals, acoustic signals, or other telemetry that can be sent using a communications system and received at the well surface 16 to, among other things, monitor the position and performance of the drill string 30, the BHA 64, and the associated drill bit 66, as well as monitor the conditions of the environment to which the BHA 64 is subjected (e.g., drilling fluid 58 flow rate).

The drilling fluid 58 may be pumped to the upper end of drill string 30 and flow through a longitudinal interior 70 of the drill string 30, through the BHA 64, and exit from nozzles formed in the drill bit 66. At the bottom end 72 of the wellbore 12, the drilling fluid 58 may mix with formation cuttings, formation fluids (e.g., fluids containing gasses and hydrocarbons) and other downhole fluids and debris. The drilling fluid mixture may then flow upwardly through an annulus 62 to return formation cuttings and other downhole debris to the well surface 16.

After drilling through a portion of the formation 14 or while drilling through the formation 14, the measurement equipment 73, such as sensors, can provide logging survey feedback to the trajectory control system 90. In at least one aspect of the present disclosure, the BHA 64 may include measurement equipment 73, such as an LWD system or other types of logging tools. The measurement equipment 73 can be any conventional logging instrument such as acoustic (sometimes referred to as sonic), neutron, gamma ray, density, photoelectron, nuclear magnetic resonance, or any other conventional logging instrument, or combinations thereof, which can be used to measure properties of formations surrounding the wellbore. The measurement equipment 73 or the BHA 64 may include a communication system operable to transmit the log data to the trajectory control system 90 on the earth's surface using telemetry such as conventional mud pulse telemetry systems or any wired, fiber optic, or wireless communication system. The trajectory control system 90 may then process or further communicate the sensor data in accordance with the embodiments of the present disclosure as described herein.

In some examples, the trajectory control system 90 can analyze the logging survey feedback from the measurement equipment 73 to determine a position (i.e., a true vertical depth and a lateral distance) and attitude (i.e., an inclination and an azimuth) of the drill bit 66 within the wellbore 12 or more specifically a position of the drill bit 66 within a particular strata of the formation 14. The trajectory control system 90 may use such position information to maintain the drilling trajectory or change the drilling trajectory to "steer" the drill bit 66 relative to the formation 14. In an example, the wellbore trajectory may be adjusted such that the trajectory is maintained within a given strata. As the drill bit 66 continues to drill the wellbore 12, the trajectory control system 90 may continue to adjust the inclination and azimuth based on the logging survey feedback information from the measurement equipment 73.

Further, while the trajectory control system 90 is depicted as surface equipment, in some examples, some or all of the trajectory control system 90 may be implemented downhole within the wellbore 12. For example, the trajectory control system 90 may be positioned as part of the BHA 64. By installing the trajectory control system 90 at the BHA 64, communications lag may be avoided (e.g., from communicating information from the measurement equipment 73 to the surface, and returning communications from the surface to the directional drilling system 71) such that the inclination and azimuth may be controlled in a quicker manner when compared to a surface position of the trajectory control system 90. Additionally, while FIG. 1 depicts the trajectory control system 90 operating in a land-based drilling environment, the trajectory control system 90 may also be implemented in an offshore drilling environment.

The trajectory control system 90 may include any suitable computer, controller, or data processing apparatus capable of being programmed to carry out the method and apparatus as further described herein. An example of such a system is illustrated in and further described with respect to FIG. 7 later below.

Figure 2A:
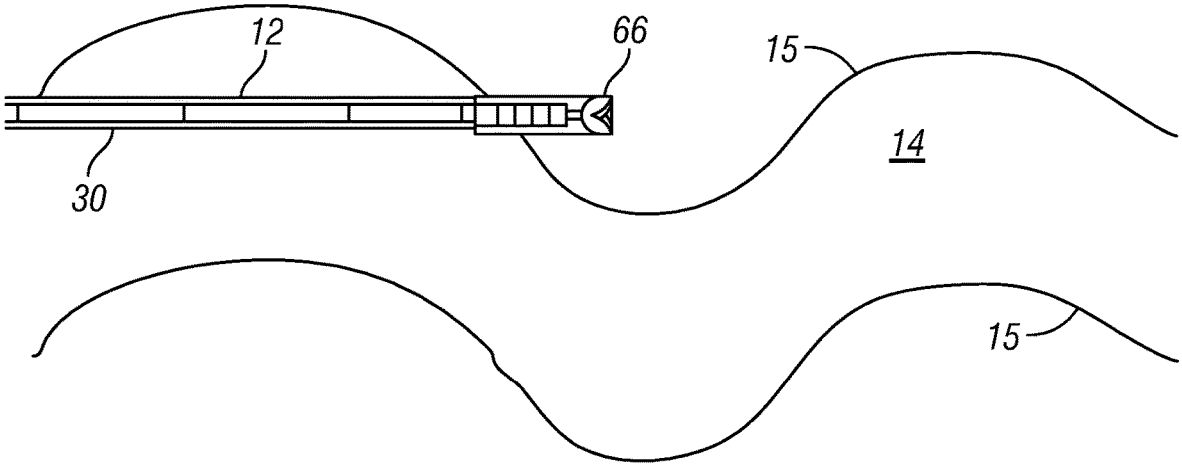
FIGS. 2A and 2B are cross-sectional schematic views of example wellbore trajectories through a subterranean formation in accordance with one or more embodiments of the present disclosure.
Figure 2B:
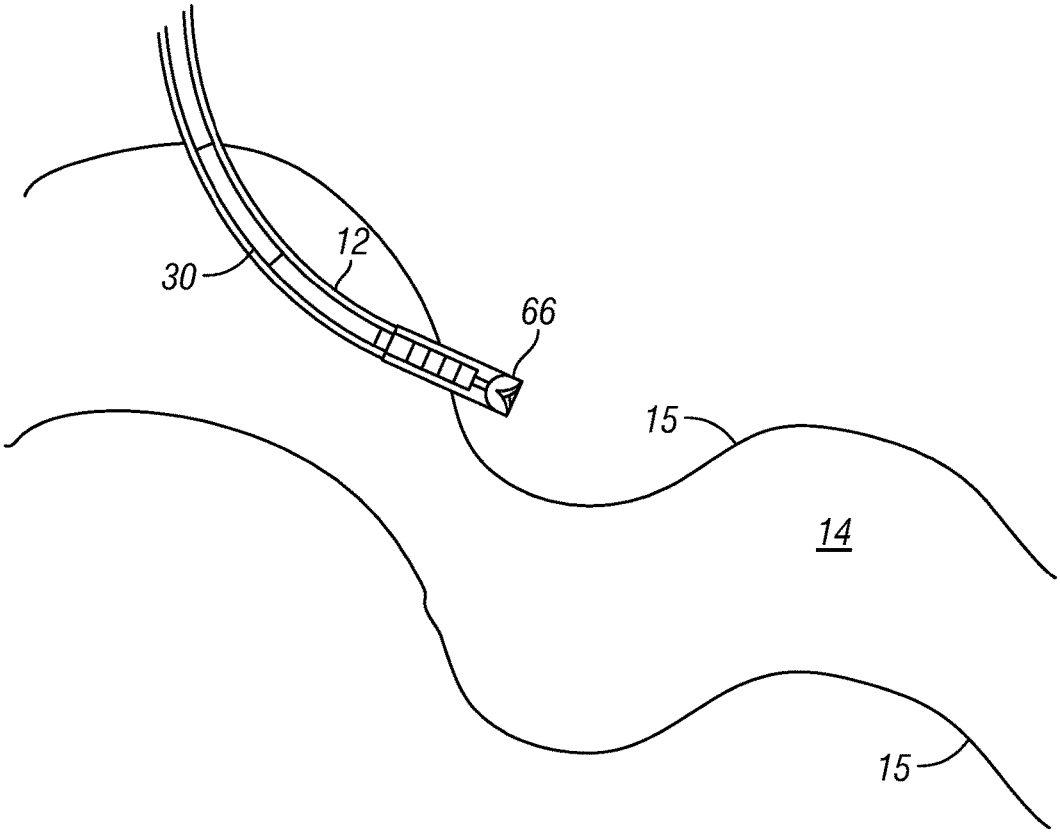

FIGS. 2A and 2B illustrate more detailed view of the drill bit 66 drilling the wellbore 12 through the subterranean formation 14. As shown, the subterranean formation 14 includes upper and lower boundary surfaces 15. Also as shown, the portion of the wellbore 12 being drilling is generally straight and horizontal. Due to the orientation of the upper boundary surface 15, as the drill bit 66 drills the wellbore 12 along the trajectory, the wellbore 12 will repeatedly extend into and out of the formation 14 as the wellbore crosses the boundary surface 15. Further, although the angle of the trajectory of the wellbore 12 with respect to the earth's surface, or dip angle, is constant in the example of FIG. 2A, the relative dip direction with respect to the boundary surface 15 is changing due to the orientation of the boundary surface 15. In the example shown in FIG. 2B, both the trajectory dip angle of the wellbore 12 and the orientation of the boundary surface 15 are changing and may continue to change as the wellbore 12 extends into and out of the formation 14. However, it should be understood that the wellbore 12 need not repeatedly extend out of or into the formation 14. Instead, the wellbore 12 may repeatedly change directions while staying within the formation 14.

Properties of the formation 14 may be known and stored in the trajectory control system 90 from previous well logs of the formation 14 or from other measurements. For example, properties such as spatial continuity of the formation 14 may be known. Other types of well logs, such as such as acoustic (sometimes referred to as sonic), neutron, gamma ray, density, photoelectron, nuclear magnetic resonance, or any other conventional logs may also have previously been performed in the formation 14. In addition to previous well logs, the measurement equipment 73 may be operated during the drilling of the wellbore 12 to obtain additional well logs of the formation 14. The wellbore 12 being drilled may be referred to as the target wellbore and therefore the logs taken during the current (as opposed to previous) drilling operation may be referred to as target well logs. The previous as well as the target well logs may collect information from one or more portions of the wellbores or from the entire wellbore. However, at least one of the target well logs will include a log of the deviated portion of the wellbore 12 that repeatedly extends into and out of the formation 14 as well as changes direction with respect to the upper or lower boundary surface 15.

Figure 3:
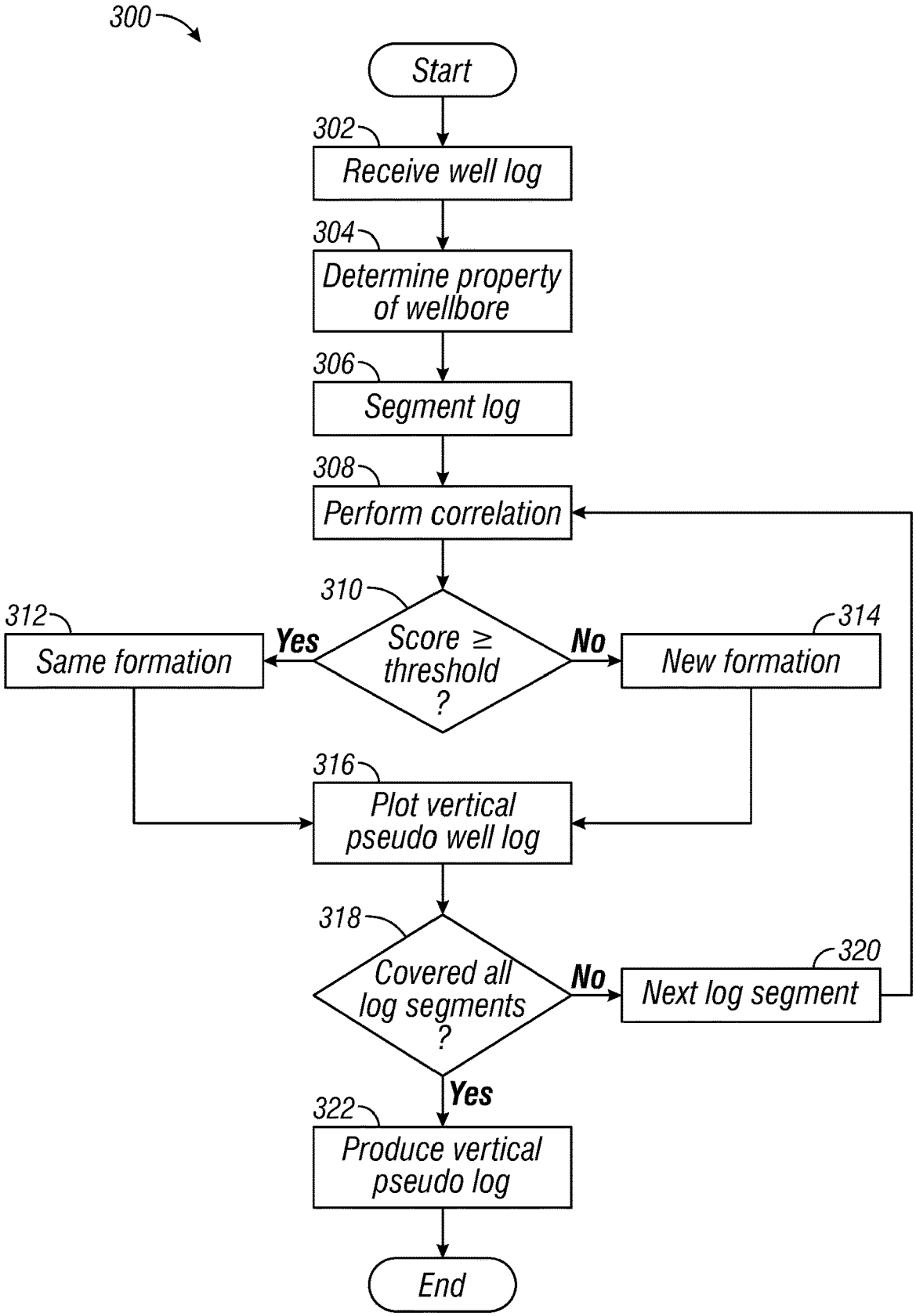
FIG. 3 is a process diagram of a process of correlating a well log and plotting a pseudo vertical well log in accordance with one or more embodiments of the present disclosure.

A correlation and pseudo vertical logging process 300 is described herein and illustrated in the process diagram shown in FIG. 3. As shown, once the target well log or logs of the wellbore extending into and out of the formation 14 are taken or are being taken, the information from the target well logs may then be communicated to the surface and received by the trajectory control system 90 at step 302. Using the trajectory control system 90, and more specifically at least one processor of the trajectory control system 90, the processor is operated to determine a property of the wellbore 12 along at least a portion of the wellbore 12 at step 304. For example, determining a property may include determining a relative dip direction of the wellbore 12 with respect to one of the boundary surfaces 15.

Figure 4:
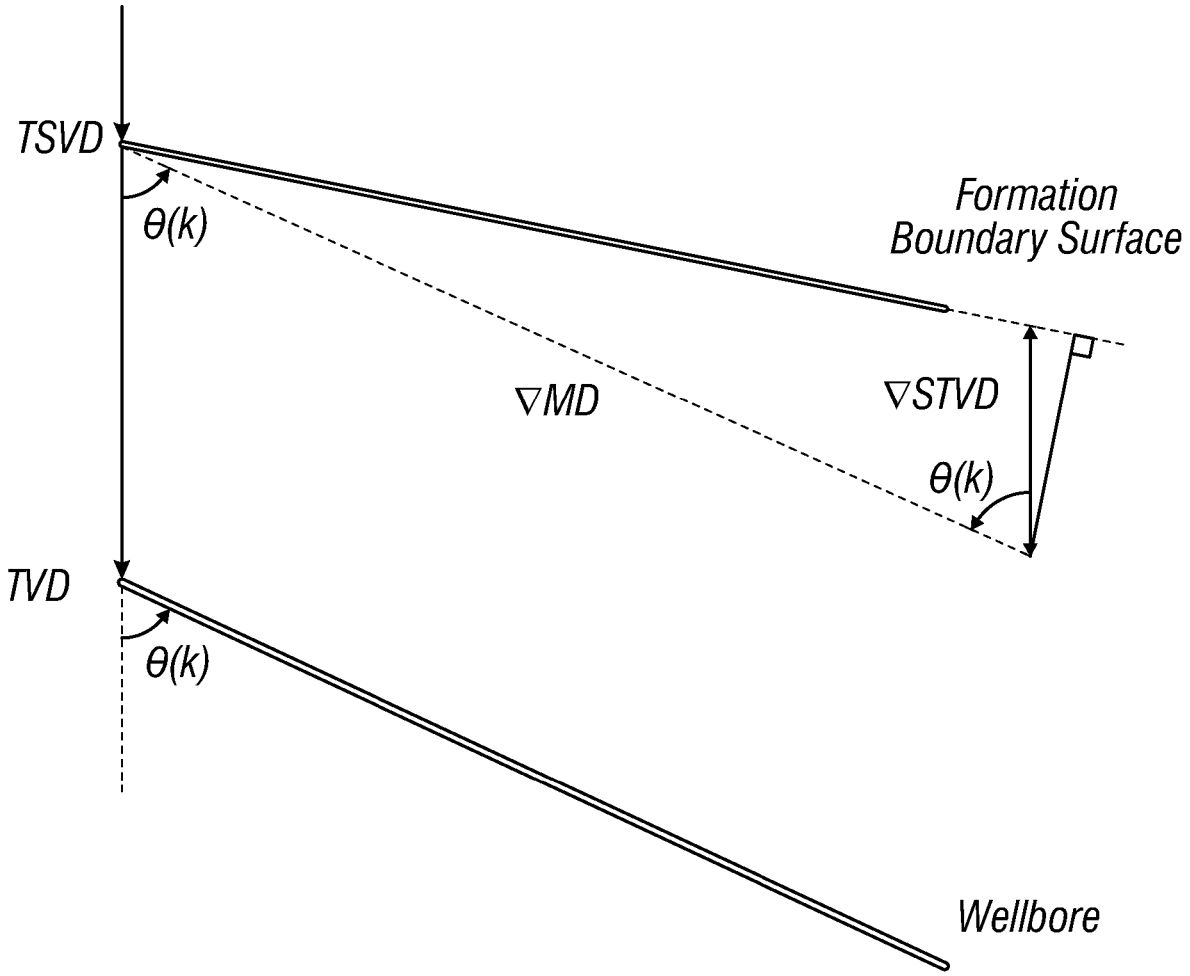
FIG. 4 illustrates context information for an example kinematics model in accordance with one or more embodiments of the present disclosure.

The relative dip direction can be determined in any suitable manner. For example, the trajectory control system 90 may be used to estimate the relative dip angle using the following kinematics model as illustrated in FIG. 4 for relative dip angle (B) estimation:

$$\beta = a\tan\left(\frac{\Delta STVD \cdot \sin(\theta)}{\Delta MD - STVD \cdot \cos(\theta)}\right) \quad \text{(Eq. 1)}$$

where :

$$\Delta STVD = \Delta MD - \Delta TSVD \quad \text{(Eq. 2)}$$

and ΔSTVD is the change in stratigraphical true vertical depth, AMD is the change in measured depth of the wellbore 12, and ΔTSVD is the change in the True Surface Vertical Depth ("TSVD"), which is the true vertical depth ("TVD") of the formation surface. Further measured depth ("MD") is the length of the wellbore 12 along the trajectory of the wellbore 12. TVD is the vertical distance from a point in the wellbore to a point at the surface. Therefore, stratigraphical true vertical depth ("STVD") is the vertical distance from a point in the wellbore 12 to a point at the boundary surface 15.

Alternatively, the trajectory control system 90 does not require a formation boundary surface and may instead estimate the relative dip angle (B) based on other well log data. For example, the trajectory control system 90 may estimate relative dip angle using an azimuthal well log of the formation 14, such as for example azimuthal resistivity, azimuthal gamma ray, azimuthal density, and other azimuthal well logs.

Figure 5:
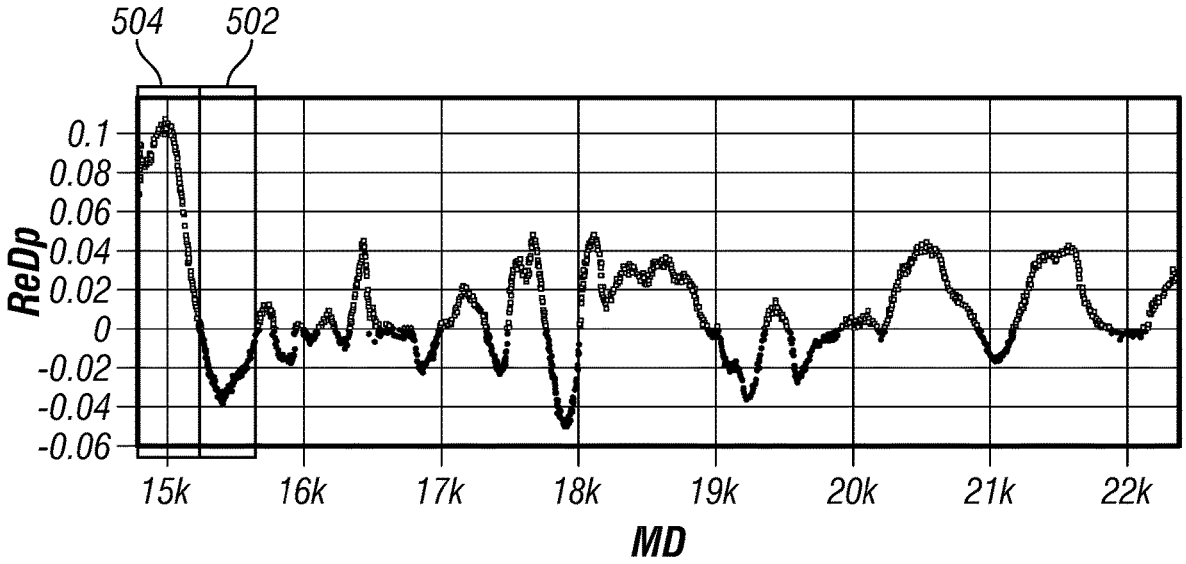
FIG. 5 illustrates a log of relative dip angle with respect to measured wellbore depth with a segmented portion in accordance with one or more embodiments of the present disclosure.

The trajectory control system 90 may then use the relative dip angle (B) to determine the relative dip angle direction. Mathematically, the relative dip angle direction is the sign of the relative dip angle (B). As shown in FIG. 5A, the relative dip angle direction is negative as the wellbore 12 is moving away from the boundary surface 15 and positive when moving toward the boundary surface 15.

Once the property of the wellbore 12 along at least a portion of the wellbore 12 is known, the trajectory control system 90 segments the well log into segments based on the property of the wellbore 12 in step 306. For example, if the property of the wellbore 12 is the relative dip direction, the trajectory control system 90 may segment the wellbore 12 based on whether the relative dip direction is positive or negative as shown in the different segments of the relative dip angle shown in FIG. 5A. The trajectory control system 90 may be programmed to perform the segmentation of the target well log automatically. Alternatively, the trajectory control system may also use known spatial continuity of the formation an additional criteria to segment the well log.

Once the well log is segmented, the trajectory control system 90 then correlates the segments as shown in step 308. For the correlation, the most recent segment, described as "signal X", is correlated with the entire historical log taken before the segment, described as "signal Y", to determine a first matching score ("MS") for the segment. Then, signal X is inverted and the inversion of signal X is correlated with signal Y to determine a second MS. Whichever is greater, the first MS or the second MS, is then selected as the MS for moving forward with process as described below. The trajectory control system 90 may be programmed to perform the correlation of the segments of the target well log automatically.

For example, referring to FIG. 5A, if relative dip direction is the property, a segment of a negative relative dip direction for the wellbore 12 is shown by box 502, and the log signal in that segment is considered signal X and the entire log previous to the segment is considered signal Y as shown in box 504. The trajectory control system 90 then compares signal X and signal Y using any suitable correlation technique to determine the first MS. For example, the trajectory control system 90 may perform the correlation using at least one of dynamic time warping, sub-sequence dynamic time warping, or formation interpretation through depth control points. The matching score ("MS") may be quantified using any suitable means. For example, the MS may be determined based on the following formula:

$$MS = \rho(X, Y) \times \left(\frac{n_X}{n} \times \frac{n_Y}{n}\right) \quad \text{(Eq. 3)}$$

which by definition falls within [−1,1] and where ρ is the correlation coefficient of signals X and Y, n_X is length of signal X, and n_Y is length of signal Y. The same process is performed for the inversion of signal X to determine a second MS and the greater of the first MS or the second MS is then selected.

Figure 6:
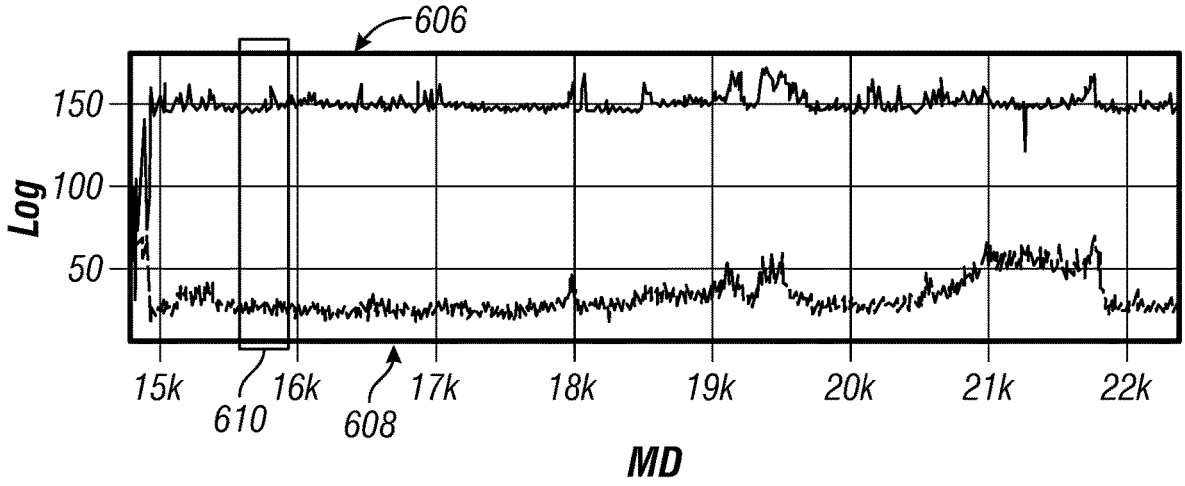
FIG. 6 illustrates multiple logs with segmented portions in accordance with one or more embodiments of the present disclosure.

Additionally, as shown in FIG. 6, a second log may be segmented into the same segments as a first log. For example as shown in FIG. 6, the log 606 is a density log and the log 608 is a gamma ray log. The density log 606 is segmented and correlated as described above and an example segment is shown by box 610. The log 608 may also be segmented into similar segments as the log 606 as shown by box 610 either simultaneously or separately. The gamma ray log 608 may then be correlated to the entire log 608 taken before the segment 610 in a similar manner as described above to determine a MS for the segment of the density log segment.

As shown in steps 310, 312, and 314, whichever is greater, the first MS or the second MS is evaluated to determine if the MS equal to or greater than a specified minimum threshold indicates that the segment is similar and therefore was taken while drilling through the same formation 14 as drilled previously. The segment is then tagged as having the same STVD as the well log previous to the segment. For example, the specified minimum threshold may be set at 0.9 but any suitable threshold may be used. An MS less than the specified minimum threshold indicates that the segment being correlated is dissimilar to the well log previous to the segment and therefore was not taken while drilling through the same formation 14. The STVD of the dissimilar segment is then estimated through other suitable means, such as a wellbore propagation model. Alternatively, the known spatial continuity of the formation from other logs may be used to estimate the STVD of the dissimilar segment.

Figure 7:
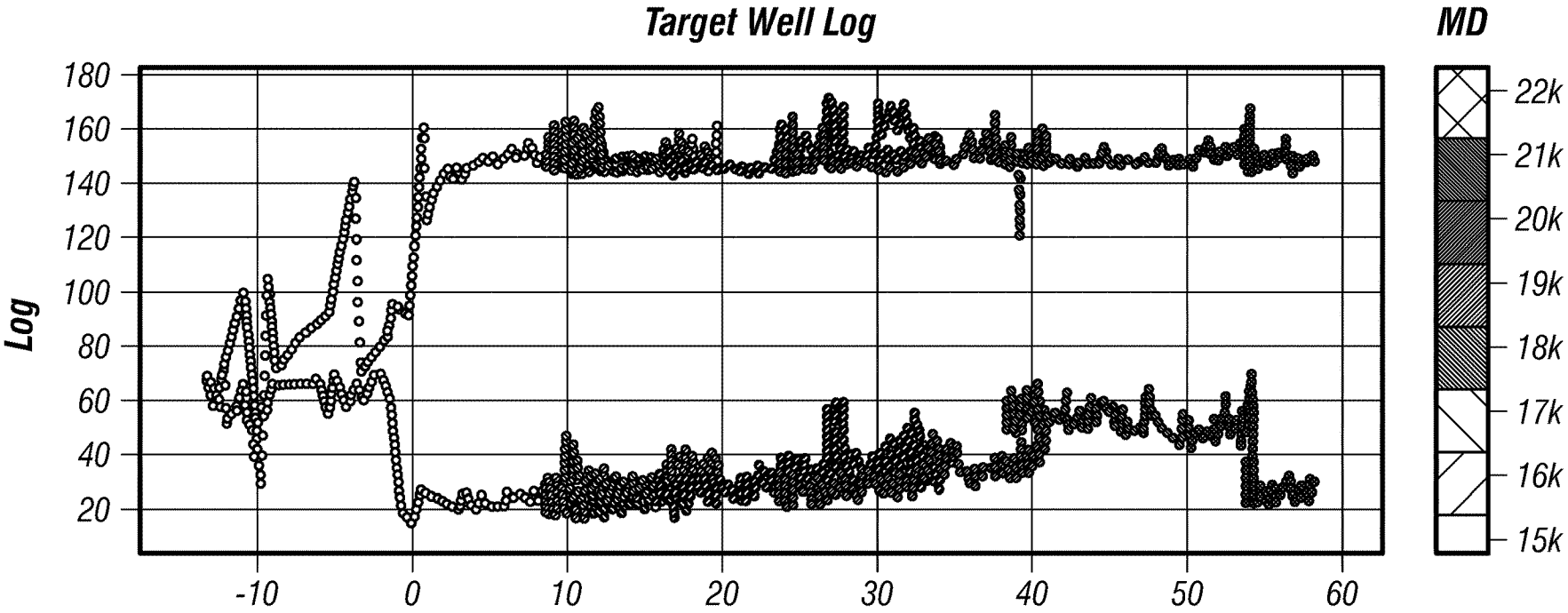
FIG. 7 illustrates a plot of a pseudo vertical well log in accordance with one or more embodiments of the present disclosure.

With the data from the target well log for the segments and the STVD for the segments known, the trajectory control system 90 converts the deviated wellbore logs into a vertical pseudo well log at step 316. The vertical pseudo well log is thus an artificial well log where data from the deviated well logs are converted into an artificial vertical well log. An example of such a plot of a vertical pseudo log is shown in FIG. 7 showing the pseudo log data as a function of STVD but also shown with an indication of MD for two different logs taken along the wellbore.

As shown in steps 318, 320, and 322, the process of correlation of segments of a well log is repeated as desired or necessary. Some or all of the segments may be correlated and the resulting determinations of STVD may be used to update the vertical pseudo log. The process of correlation may also be performed for other well logs of different properties of the formation 14 to develop multiple vertical pseudo logs.

The vertical pseudo log or logs may then be used to develop models of the formation that may be stored in the trajectory control system 90. The trajectory control system 90 may also use the vertical pseudo logs to determine a target wellbore path for the wellbore 12 through the formation 14. With the target wellbore path determined, the trajectory control system 90 may then communicate commands to and control the directional drilling system 71 to direct the trajectory of the drill bit along the target wellbore path. The correlation technique and pseudo vertical well logs may be updated as the wellbore 12 is being drilled and the trajectory control system 90 may continue to use the updated information to determine and control the drilling of the wellbore 12 along the target wellbore path. The correlation process may be performed continuously during the drilling of the wellbore 12 or may be performed intermittently upon certain criteria, such as but not limited to after drilling a certain amount of MD.

The described process of correlation is performed using only target well logs. Comparing to conventional well log correlation techniques that rely on offset well log data, the correlation using only target well logs overcomes limitations related to the heterogeneity of geophysical measurements among different wellbores. The source of such heterogeneity may include but is not limited to differences in geologic condition and data-quality. Correlation between homogeneous logs from the same target wellbore avoids such issues because the data quality from the same wellbore are likely to be the most similar. The geologic measurement (especially over the same formation) from the same wellbore should be the most accurate correlation reference as well.

The technique of correlation using only target well logs is also different from conventional well log correlation techniques using different wellbores because there may be surfaces repeatedly appearing in a target well, such as repeatedly encountering the formation boundary surface 15, which is a scenario that the conventional well log correlation techniques will not encounter and cannot address. Other repeated scenarios may also be used, such as repeatedly changing directions with respect to a formation. The correlation techniques discussed herein however use a wellbore property to deal with repeated surface encounters in the target well.

Figure 8:
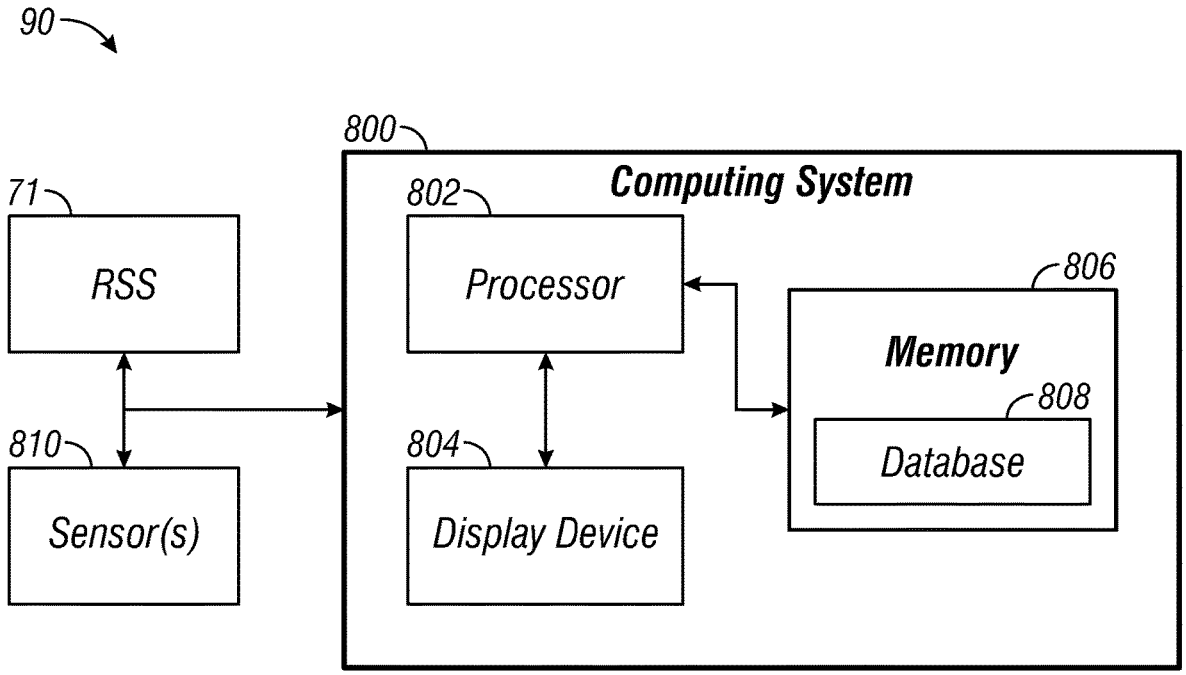
FIG. 8 illustrates a block diagram of an example computing system that may be employed to practice the concepts, methods, and techniques disclosed herein, and variations thereof.

FIG. 8 illustrates a block diagram of an example computing system 800 that may be employed to practice the concepts, methods, and techniques disclosed herein, and variations thereof. For example, the computing system 800 may be used as the trajectory control system 90 disclosed in FIG. 1. The computing system 800 incudes a plurality of components of the system that are in electrical communication with each other, in some examples using a bus. The computing system 800 may include any suitable computer, controller, or data processing apparatus capable of being programmed to carry out the method and apparatus as described herein. Although shown local to the well system 10, the trajectory control system 90 may be located remotely from the well system 10 at another site or a distributed system in the "cloud" and communicate through wired or wireless communication means.

The computing system 800 includes a processor 802 (possibly including multiple processors, multiple cores, multiple nodes, and/or implementing multi-threading, etc.). The processor 802 can execute one or more operations for implementing some examples. The processor 802 can execute instructions stored in the memory 806 to perform the operations. The processor 802 can include one processing device or multiple processing devices. Non-limiting examples of the processor 802 include a Field-Programmable Gate Array ("FPGA"), an application-specific integrated circuit ("ASIC"), a microprocessor, etc.

The computing system 800 also includes a memory 806. The memory 806 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the possible realizations of machine-readable media. The memory 806 may include non-volatile memory of any type that retains stored information when powered off. Non-limiting examples of the memory 806 include electrically erasable and programmable read-only memory ("EEPROM"), flash memory, or any other type of non-volatile memory. In some examples, at least some of the memory 806 can include a medium from which the processor 802 can read instructions. A computer-readable medium can include electronic, optical, magnetic, or other storage devices capable of providing the processor 802 with computer-readable instructions or other program code. Non-limiting examples of a computer-readable medium include (but are not limited to) magnetic disk(s), memory chip(s), ROM, RAM, an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, JAVA®; a dynamic programming language such as Python; a scripting language such as Perl programming language or PowerShell script language; or similar programming languages, etc.

The memory 806 can also include a database 808, which can include any amount and combination of the content described in previous examples. The database 808 can store formation or wellbore data, mathematical equations, algorithms, models, or any combination of these, among other things.

The computing system 800 may also include a display device 804. The display device 804 can receive display signals from the processor 802 and responsively output any information related to the wellbore or any other information useable to manage wellbore drilling operations. One example of the display device 804 can include a liquid crystal display.

The computing system 800 may also include a communications bus (not shown) (e.g., PCI, ISA, PCI-Express, HYPERTRANSPORT® bus, INFINIBAND® bus, NuBus, etc.) and a network interface (not shown) (e.g., a Fiber Channel interface, an Ethernet interface, an internet small computer system interface, SONET interface, wireless interface, etc.).

In some examples, the components shown in FIG. 4 (e.g., the processor 802, the display device 804, and the memory 806) can be integrated into a single structure. For example, the components can be within a single housing. In other examples, the components shown in FIG. 4 can be distributed (e.g., in separate housings) and in electrical communication with each other.

Sensor(s) 810 can be communicatively coupled to the computing system 800 to transmit information about the location of the drill bit 66 within the wellbore 12. Examples of the sensors 810 can include MWD sensors useable to measure position and attitude of the drill bit 66. In some examples, the sensors 810 can be integrated on the directional drilling system 71 (e.g., the sensors 810 are within the directional drilling system 71).

As previously mentioned, the computing system 800 may be a controller that can control the different operations that can occur in the response inputs from the sensors 810 and/or calculations based on inputs from the sensors 810 using any of the techniques described herein, and any equivalents thereof, to generate outputs to the steering controls 421. For example, the computing system 800 can communicate instructions to the appropriate equipment, devices, etc. to alter control the inclination of the drill bit performing a drilling operation being monitored by the sensors 810. Any one of the previously described functionalities may be partially (or entirely) implemented in hardware and/or on the processor 802. For example, the functionality may be implemented with an application specific integrated circuit, in logic implemented in the processor 802, in a co-processor on a peripheral device or card, etc. Further, realizations may include fewer or additional components not illustrated in FIG. 4 (e.g., video cards, audio cards, additional network interfaces, peripheral devices, etc.).

The computing system 800 may be coupled to the sensors 810 using any type of wired or wireless connection(s), and may receive data, such as measurement data, obtained by the sensors 810. The sensors 810 may include any of the sensors associated with a wellbore environment, a drill string, and/or a bottom hole assembly as described herein. Measurement data may include any of the data associated with a geological formation and/or measurements obtained during the drilling process of the geological formation. Measurement data may also include a measured current depth for the drill bit being used to perform the drilling process as measured by the sensors, and any measurement data obtained by the sensors over the path of the wellbore being drilled by the drill bit as part of the drilling process. The computing system 800 may include circuitry, such as analog-to-digital (A/D) converters and buffers that allow the computing system 800 to receive electrical signals directly from one or more of the sensors 810, and/or data provided as an output from one or more of the sensors 810.

Any data related to the geological formation and/or measurements obtained during the drilling process of the geological formation may be stored in any of the memory locations accessible by computing system 800, such as memory 806. Data may also be entered into the memory 806 through an input device (not shown in FIG. 4) such as a computer keyboard, for example by a system user, for use in performing the methods and techniques described in this disclosure, and/or any equivalents thereof.

The steering controls for the directional drilling system 71 may also be coupled to the computing system 800. Any of the outputs that may be generated in part or in whole using computing system 800 and/or as described herein may be provided as outputs to the directional drilling system 71. The computing system 800 may include circuitry (not specifically shown in FIG. 4) such as buffer and driver circuitry, that allow the computing system 800 to provide electrical signals and/or data output signal to the steering controls of the directional drilling system 71.

With respect to computing system 800, basic features here may easily be substituted for improved hardware or firmware arrangements as they are developed. In some examples, the memory 806 includes non-volatile memory and can be a hard disk or other types of computer readable media which can store data that are accessible by a computer, such as magnetic cassettes, flash memory cards, solid state memory devices, digital versatile disks (DVDs), cartridges, RAM, ROM, a cable containing a bit stream, and hybrids thereof.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit", "module", or "system". The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the JAVA® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a computing system 800, some embodiments can be any type of device or apparatus to perform operations described herein.

Examples of the above embodiments include:

Example 1 is a system for characterizing a subterranean formation, comprising: a drill bit configured to drill a deviated wellbore through the formation and that repeatedly changes direction with respect to the formation; a directional drilling system operable to control a direction the drill bit drills the wellbore; measurement equipment configured to detect a property of the formation in a well log along at least a portion of the wellbore; a trajectory control system comprising a processor, wherein the processor is operable to: receive the well log of the deviated wellbore repeatedly changing direction with respect to the formation; determine a property of the wellbore along the portion of the wellbore; segment the well log of the deviated wellbore into segments based on the property; correlate one of the segments with the well log previous to the segment to determine a matching score for the segment; wherein if the matching score is equal to or greater than a minimum threshold, indicate that the segment was taken in the formation and at the same stratigraphical true vertical depth ("STVD") as the well log previous to the segment; wherein if the matching score is less than the minimum threshold, indicate that the segment was not taken in the formation and not at the same STVD and also estimate the STVD of the segment; plot a vertical pseudo log of the formation with respect to STVD based on the segment; correlate other segments of the well log; update the vertical pseudo log based on the correlated segments; and produce a graphical representation of the vertical pseudo log.

In Example 2, the embodiments of any preceding paragraph or combination thereof further include wherein the processor being operable to determine a property of the wellbore comprises being operable to determine a relative dip direction of the wellbore with respect to a boundary surface of the formation.

In Example 3, the embodiments of any preceding paragraph or combination thereof further include wherein the processor being operable to segment the log of the deviated wellbore into segments comprises being operable to segment the log based on the relative dip direction.

In Example 4, the embodiments of any preceding paragraph or combination thereof further include the processor being operable to: invert the segment and correlate the inverted segment with the well log previous to the segment to determine a second matching score for the segment; and indicate that the segment was taken in the formation and at the same STVD if the greater of the matching score or the second matching score is equal to or greater than the minimum threshold.

In Example 5, the embodiments of any preceding paragraph or combination thereof further include wherein the processor being operable to estimate the STVD of the segment further comprises the processor being operable to estimate the STVD using a wellbore propagation model.

In Example 6, the embodiments of any preceding paragraph or combination thereof further include wherein the processor is further operable to determine a target wellbore path for a wellbore through the formation based on the vertical pseudo log.

In Example 7, the embodiments of any preceding paragraph or combination thereof further include the processor being able to control the directional drilling system to drill the wellbore along the target wellbore path.

In Example 8, the embodiments of any preceding paragraph or combination thereof further include wherein the processor is operable to segment the well log and correlate one of the segments automatically.

Example 9 is a method of characterizing a subterranean formation, the method comprising: receiving, by a processor, a well log of a deviated wellbore repeatedly changing direction with respect to the formation; determining, using the processor, a property of the wellbore along at least a portion of the wellbore; segmenting, using the processor, the well log of the deviated wellbore into segments based on the property; correlating, using the processor, one of the segments with the well log previous to the segment to determine a matching score for the segment; if the matching score is equal to or greater than a minimum threshold, indicating, using the processor, that the segment was taken in the formation and at the same stratigraphical true vertical depth ("STVD") as the well log previous to the segment; if the matching score is less than the minimum threshold, indicating, using the processor, that the segment was not taken in the formation and not at the same STVD and also estimating the STVD of the segment; plotting, using the processor, a vertical pseudo log of the formation with respect to STVD based on the segment; correlating, using the processor, other segments of the well log; updating, using the processor, the vertical pseudo log based on the correlated segments; and producing, using the processor, a graphical representation of the vertical pseudo log.

In Example 10, the embodiments of any preceding paragraph or combination thereof further include wherein determining a property of the wellbore further comprises determining a relative dip direction of the wellbore with respect to a boundary surface of the formation.

In Example 11, the embodiments of any preceding paragraph or combination thereof further include wherein segmenting the log of the deviated wellbore into segments comprises segmenting the log based on the relative dip direction.

In Example 12, the embodiments of any preceding paragraph or combination thereof further include: inverting the segment and correlating the inverted segment with the well log previous to the segment to determine a second matching score for the segment; and indicating that the segment was taken in the formation and at the same STVD if the greater of the matching score or the second matching score is equal to or greater than the minimum threshold.

In Example 13, the embodiments of any preceding paragraph or combination thereof further include wherein estimating the STVD of the segment further comprises estimating the STVD of the segment using a wellbore propagation model.

In Example 14, the embodiments of any preceding paragraph or combination thereof further include determining, using the processor, a target wellbore path for a wellbore through the formation based on the vertical pseudo log.

In Example 15, the embodiments of any preceding paragraph or combination thereof further include controlling, using the processor, a directional drilling system to drill the wellbore along the target wellbore path.

Example 16 is a non-transitory computer-readable medium comprising program code that is executable by a processing device for causing the processing device to perform a method of characterizing a subterranean formation, the method comprising: receiving a well log of a deviated wellbore repeatedly changing direction with respect to the formation; determining a property of the wellbore along at least a portion of the wellbore; segmenting the well log of the deviated wellbore into segments based on the property; correlating one of the segments with the well log prior to the segment to determine a matching score for the segment; if the matching score is equal to or greater than a minimum threshold, indicating that the segment was taken in the formation and at the same stratigraphical true vertical depth ("STVD") as the well log previous to the segment; if the matching score is less than the minimum threshold, indicating that the segment was not taken in the formation and not at the same STVD and also estimating the STVD of the segment; plotting a vertical pseudo log of the formation with respect to STVD based on the segments; correlating other segments of the well log; updating the vertical pseudo log based on the correlated segments; and producing a graphical representation of the vertical pseudo log.

In Example 17, the embodiments of any preceding paragraph or combination thereof further include wherein determining a property of the wellbore further comprises determining a relative dip direction of the wellbore with respect to a boundary surface of the formation.

In Example 18, the embodiments of any preceding paragraph or combination thereof further include wherein segmenting the log of the deviated wellbore into segments comprises segmenting the log based on the relative dip direction.

In Example 19, the embodiments of any preceding paragraph or combination thereof further include: inverting the segment and correlating the inverted segment with the well log previous to the segment to determine a second matching score for the segment; and indicating that the segment was taken in the formation and at the same STVD if the greater of the matching score or the second matching score is equal to or greater than the minimum threshold.

In Example 20, the embodiments of any preceding paragraph or combination thereof further include wherein the method further comprises: determining a target wellbore path for a wellbore through the formation based on the vertical pseudo log; and controlling a directional drilling system to drill the wellbore along the target wellbore path.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of information. Such a user interface can be operated in conjunction with the communications unit and the bus. Various components of the system can be integrated such that processing identical to or similar to the processing schemes discussed with respect to various embodiments herein can be performed.

While descriptions herein may relate to "comprising" various components or steps, the descriptions can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the desired properties of the present disclosure. As used herein, "about", "approximately", "substantially", and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A system for characterizing a subterranean formation, comprising:

a drill bit configured to drill a deviated wellbore through the subterranean formation and that changes direction with respect to the subterranean formation;

a directional drilling system operable to control a direction the drill bit drills the deviated wellbore;

measurement equipment configured to detect a property of the subterranean formation in a well log along at least a portion of the deviated wellbore as the drill bit drills;

a trajectory control system in electrical communication with the directional drilling system and the measurement equipment, the trajectory control system comprising a processor, wherein the processor is operable to:

receive the well log of the deviated wellbore changing direction with respect to the formation from the measurement equipment as the drill bit drills;

determine the property of the deviated wellbore along the portion of the deviated wellbore;

segment the well log of the deviated wellbore into segments based on the property;

correlate one of the segments with the well log previous to the segment to determine a matching score for the segment;

wherein if the matching score is equal to or greater than a minimum threshold, indicate that the segment was taken in the subterranean formation and at the same stratigraphical true vertical depth ("STVD") as the well log previous to the segment;

wherein if the matching score is less than the minimum threshold, indicate that the segment was not taken in the subterranean formation and not at the same STVD and also estimate the STVD of the segment;

plot a vertical pseudo log of the subterranean formation with respect to STVD based on the segment;

correlate other segments of the well log;

update the vertical pseudo log based on the correlated segments;

determine a target wellbore path for a wellbore through the subterranean formation based on the vertical pseudo log; and control the directional drilling system to direct a trajectory of the drill bit along the target wellbore path from the deviated wellbore.

2. The system of claim 1, wherein the processor being operable to determine a property of the wellbore comprises being operable to determine a relative dip direction of the wellbore with respect to a boundary surface of the formation.

3. The system of claim 2, wherein the processor being operable to segment the log of the deviated wellbore into segments comprises being operable to segment the log based on the relative dip direction.

4. The system of claim 1, further comprising the processor being operable to:

invert the segment and correlate the inverted segment with the well log previous to the segment to determine a second matching score for the segment; and indicate that the segment was taken in the formation and at the same STVD if the greater of the matching score or the second matching score is equal to or greater than the minimum threshold.

5. The system of claim 1, wherein the processor being operable to estimate the STVD of the segment further comprises the processor being operable to estimate the STVD using a wellbore propagation model.

6. The system of claim 1, wherein the processor is further operable to produce a graphical representation of the vertical pseudo log.

7. The system of claim 1, wherein the processor is operable to segment the well log and correlate one of the segments automatically.

8. A method of characterizing a subterranean formation, the method comprising:

drilling, with a drill bit, a deviated wellbore through the subterranean formation that changes direction with respect to the subterranean formation;

controlling, with a directional drilling system, a direction of the drill bit drilling the deviated wellbore;

detecting, with measurement equipment, a property of the subterranean formation in a well log along at least a portion of the deviated wellbore as the drill bit drills;

receiving, by a processor in electrical communication with the measurement equipment, the well log of the deviated wellbore changing direction with respect to the formation as the drill bit drills;

determining, using the processor, the property of the deviated wellbore along at least a portion of the deviated wellbore;

segmenting, using the processor, the well log of the deviated wellbore into segments based on the property;

correlating, using the processor, one of the segments with the well log previous to the segment to determine a matching score for the segment;

if the matching score is equal to or greater than a minimum threshold, indicating, using the processor, that the segment was taken in the subterranean formation and at the same stratigraphical true vertical depth ("STVD") as the well log previous to the segment;

if the matching score is less than the minimum threshold, indicating, using the processor, that the segment was not taken in the subterranean formation and not at the same STVD and also estimating the STVD of the segment;

plotting, using the processor, a vertical pseudo log of the subterranean formation with respect to STVD based on the segment;

correlating, using the processor, other segments of the well log;

updating, using the processor, the vertical pseudo log based on the correlated segments;

determining, using the processor, a target wellbore path for a wellbore through the subterranean formation based on the vertical pseudo log; and controlling, using the processor, the directional drilling system to direct a trajectory of the drill bit along the target wellbore path from the deviated wellbore.

9. The method of claim 8, wherein determining a property of the wellbore further comprises determining a relative dip direction of the wellbore with respect to a boundary surface of the formation.

10. The method of claim 9, wherein segmenting the log of the deviated wellbore into segments comprises segmenting the log based on the relative dip direction.

11. The method of claim 10, further comprising:

inverting the segment and correlating the inverted segment with the well log previous to the segment to determine a second matching score for the segment; and indicating that the segment was taken in the formation and at the same STVD if the greater of the matching score or the second matching score is equal to or greater than the minimum threshold.

12. The method of claim 8, wherein estimating the STVD of the segment further comprises estimating the STVD of the segment using a wellbore propagation model.

13. The method of claim 8, further comprising producing, using the processor, a graphical representation of the vertical pseudo log.

14. A non-transitory computer-readable medium comprising program code that is executable by a processing device for causing the processing device to perform a method of characterizing a subterranean formation, the method comprising:

controlling a directional drilling system to direct a drill bit drilling a deviated wellbore through the subterranean formation;

detecting a property of the subterranean formation in a well log along at least a portion of the deviated wellbore as the drill bit drills;

receiving the well log of the deviated wellbore changing direction with respect to the subterranean formation;

determining the property of the wellbore along the portion of the deviated wellbore;

segmenting the well log of the deviated wellbore into segments based on the property;

correlating one of the segments with the well log prior to the segment to determine a matching score for the segment;

if the matching score is equal to or greater than a minimum threshold, indicating that the segment was taken in the formation and at the same stratigraphical true vertical depth ("STVD") as the well log previous to the segment;

if the matching score is less than the minimum threshold, indicating that the segment was not taken in the formation and not at the same STVD and also estimating the STVD of the segment;

plotting a vertical pseudo log of the subterranean formation with respect to STVD based on the segments;

correlating other segments of the well log;

updating the vertical pseudo log based on the correlated segments; and determining a target wellbore path for a wellbore through the subterranean formation based on the vertical pseudo log; and controlling the directional drilling system to direct a trajectory of the drill bit along the target wellbore path from the deviated wellbore.

15. The non-transitory computer-readable medium of claim 14, wherein determining a property of the wellbore further comprises determining a relative dip direction of the wellbore with respect to a boundary surface of the formation.

16. The non-transitory computer-readable medium of claim 15, wherein segmenting the log of the deviated wellbore into segments comprises segmenting the log based on the relative dip direction.

17. The non-transitory computer-readable medium of claim 16, the method further comprising:

inverting the segment and correlating the inverted segment with the well log previous to the segment to determine a second matching score for the segment; and indicating that the segment was taken in the formation and at the same STVD if the greater of the matching score or the second matching score is equal to or greater than the minimum threshold.

18. The non-transitory computer-readable medium of claim 14, wherein the method further comprises:

producing a graphical representation of the vertical pseudo log.

* * * * *